US007861368B2

(12) United States Patent
Hackwell et al.

(10) Patent No.: US 7,861,368 B2
(45) Date of Patent: Jan. 4, 2011

(54) VACUUM CLEANING HEAD

(75) Inventors: Paul Cedric Campbell Hackwell, Atworth (GB); Simon Nicholas Langham, Pangbourne (GB)

(73) Assignee: Dyson Technology Limited, Malmesbury (GB)

( * ) Notice: Subject to any disclaimer, the term of this patent is extended or adjusted under 35 U.S.C. 154(b) by 1490 days.

(21) Appl. No.: 10/528,804

(22) PCT Filed: Sep. 18, 2003

(86) PCT No.: PCT/GB03/04058

§ 371 (c)(1),
(2), (4) Date: Mar. 23, 2005

(87) PCT Pub. No.: WO2004/028330

PCT Pub. Date: Apr. 8, 2004

(65) Prior Publication Data

US 2005/0251953 A1 Nov. 17, 2005

(30) Foreign Application Priority Data

Sep. 24, 2002 (GB) ..... 0222079.6

(51) Int. Cl.

| | |
|---|---|
| ***A47L 5/10*** | (2006.01) |
| ***A47L 5/26*** | (2006.01) |
| ***A47L 5/00*** | (2006.01) |
| ***A47L 9/00*** | (2006.01) |
| ***A47L 9/04*** | (2006.01) |
| ***A47L 9/06*** | (2006.01) |

(52) U.S. Cl. ..... 15/387; 15/331; 15/332; 15/375

(58) Field of Classification Search ..... 15/332, 15/363–403, 331

See application file for complete search history.

(56) References Cited

U.S. PATENT DOCUMENTS

| | | | | | |
|---|---|---|---|---|---|
| 2,648,396 | A | * | 8/1953 | Kirby | 15/352 |
| 2,904,816 | A | | 9/1959 | Skolfield | |
| 2,904,817 | A | * | 9/1959 | Brennan | 15/375 |
| 5,008,973 | A | | 4/1991 | Woerwag | |
| 5,088,149 | A | * | 2/1992 | Berg et al. | 15/322 |
| 5,293,665 | A | * | 3/1994 | Worwag | 15/387 |
| 5,345,650 | A | * | 9/1994 | Downham et al. | 15/331 |
| 5,416,948 | A | * | 5/1995 | Worwag | 15/331 |
| 5,592,716 | A | * | 1/1997 | Moren et al. | 15/412 |
| 5,802,666 | A | | 9/1998 | Jung | |
| 5,950,275 | A | | 9/1999 | Woerwag | |
| 6,099,661 | A | * | 8/2000 | Conrad | 134/21 |

FOREIGN PATENT DOCUMENTS

DE 4229030 A1 3/1994

(Continued)

OTHER PUBLICATIONS

Japanese Office Action Mailed on Jan. 15, 2008 directed to counterpart application No. JP-2004-539183 (5 pages).
Smith, U.S. Office Action mailed Nov. 14, 2007, directed to related U.S. Appl. No. 10/528,790; 5 pages.
Smith, U.S. Office Action mailed Dec. 20, 2007, directed to related U.S. Appl. No. 10/528,790; 9 pages.
Smith, U.S. Office Action mailed Apr. 10, 2008, directed to related U.S. Appl. No. 10/528,790; 6 pages.

*Primary Examiner*—Bryan R Muller
(74) *Attorney, Agent, or Firm*—Morrison & Foerster LLP

(57) ABSTRACT

A vacuum cleaning head includes a rotatable brush bar and an air turbine driving the brush bar. An air inlet admits air to drive the turbine. A button is movable between an open position, in which it admits air to the turbine, and a closed position in which it closes the inlet and prevents air from reaching the turbine. The button is movable in response to the speed of rotation of the turbine or to the flow of air to or through the turbine exceeding a predetermined limit.

26 Claims, 9 Drawing Sheets

U.S. PATENT DOCUMENTS

| | | | | |
|---|---|---|---|---|
| 6,151,752 | A * | 11/2000 | Melzner et al. | 15/387 |
| 6,615,445 | B2 | 9/2003 | Woerwag | |
| 7,441,307 | B2 | 10/2008 | Smith | |
| 2006/0162119 | A1 | 7/2006 | Smith | |

FOREIGN PATENT DOCUMENTS

| | | | |
|---|---|---|---|
| DE | 4229030 | A1 * | 3/1994 |
| DE | 19507528 | A1 | 9/1996 |
| DE | 19826041 | C1 | 11/1999 |
| GB | 2253780 | A | 9/1992 |
| GB | 2322291 | A | 8/1998 |
| JP | 61-280828 | | 12/1986 |
| JP | 01-223920 | | 9/1989 |
| JP | 01221128 | | 9/1989 |
| JP | 5-317213 | | 12/1993 |
| JP | 05317213 | A * | 12/1993 |
| JP | 8-187208 | | 7/1996 |
| JP | 9-23998 | | 1/1997 |
| JP | 10-286202 | | 10/1998 |
| JP | 10286202 | A * | 10/1998 |
| JP | 10-328092 | | 12/1998 |
| JP | 11-9523 | | 1/1999 |
| WO | WO-99/65376 | A1 | 12/1999 |

* cited by examiner

VACUUM CLEANING HEAD

FIELD OF THE INVENTION

This invention relates to a vacuum cleaning head which can be used with, or form part of a vacuum cleaner.

BACKGROUND OF THE INVENTION

Vacuum cleaners are generally supplied with a range of tools for dealing with specific types of cleaning. The tools include a floor tool for general on-the-floor cleaning. It is well-known to provide a floor tool in which a brush bar is rotatably mounted within a suction opening on the underside of the tool, with the brush bar being driven by an air turbine. The brush bar serves to agitate the floor surface beneath the tool so as to release dirt, dust, hair, fluff and other debris from the floor surface where it can then be carried by the flow of air to the vacuum cleaner itself. The turbine can be driven solely by 'dirty' air which enters the tool via the suction opening, it can be driven solely by 'clean' air which enters the tool via a dedicated inlet which is separate from the main suction opening, or it can be driven by a combination of dirty and clean air. 'Dirty air' turbine-driven tools have a disadvantage in that they can easily become fouled by the dirty airflow. They also have a disadvantage in that the speed at which the turbine rotates can increase quite rapidly when the tool is lifted from a surface.

U.S. Pat. No. 5,950,275 and DE 42 29 030 both show dirty air turbine-driven tools where a speed limiting function is operable when the tool is lifted from a surface. In one of the tools, the speed limiting device is a floor engaging wheel which controls the angular position of an air inlet with respect to the turbine.

'Clean air' turbine-driven tools can also suffer from an increase in speed under certain conditions. A full or partial blockage of the airflow path through the main suction inlet to the tool can cause an increased amount of air to flow through the air turbine inlet, which increases the speed of the turbine and the brush bar. However, in view of the different causes of an overspeed condition in clean air and dirty air turbine-driven tools, the solutions proposed for dirty air turbine-driven tools are unsuitable for use in clean air turbine-driven tools.

SUMMARY OF THE INVENTION

Accordingly, the present invention provides a vacuum cleaning head comprising a housing, an agitator for agitating a floor surface which is rotatably mounted in the housing, an air turbine for driving the agitator, an air inlet for admitting air to the turbine, and a control for preventing rotation of or reducing the speed of rotation of the agitator, wherein the control is responsive to the speed of rotation of the turbine, or flow of air to or through the turbine.

The control can take the form of a mechanical arrangement which directly responds to the speed of rotation of the turbine. A centrifugal braking mechanism can be fitted to the drive shaft from the turbine, with braking elements moving radially outwards to act on a braking surface surrounding the drive shaft when the speed of rotation of the turbine exceeds a predetermined limit. Alternatively, a centrifugal clutch can be fitted in the drive shaft from the turbine. These arrangements have the advantage of providing the user with a warning noise when they operate.

More preferably, the control is a valve which is movable between an open position, in which it admits air to the turbine, thereby allowing the turbine to drive the agitator, and a closed position in which it prevents air from reaching the turbine, thereby preventing the turbine from driving the agitator.

The control can comprise a movable part having an interior volume which communicates with the main airflow path to the turbine, the movable part being responsive to a pressure difference between the interior volume and ambient air.

Preferably the control is also movable into the inoperable position by a user, such as when a user decides to use the cleaning head on a hard floor or delicate surface. Providing one control which can either be manually or automatically operated to turn off the agitator has a considerable benefit in making the cleaning head easier to use.

In a turbine driven tool which has a dedicated air inlet for air to drive the turbine which is separate from the main, floor engaging inlet, there can be a difficulty in driving the turbine at a sufficient speed. When viewed in terms of the amount of resistance experienced by the airflow, the path through the main inlet offers a lower resistance than the path through the turbine inlet. Thus, the airflow will tend to take the lower resistance path through the main inlet.

In the invention, the vacuum cleaning head can be a tool which attaches to the end of a wand or hose of a cylinder (canister, barrel) or upright vacuum cleaner, or it can form part of a vacuum cleaner itself, such as the cleaning head of an upright vacuum cleaner.

BRIEF DESCRIPTION OF THE DRAWINGS

Embodiments of the invention will now be described, by way of example only, with reference to the accompanying drawings, in which.

DETAILED DESCRIPTION OF THE INVENTION

Figure 1:
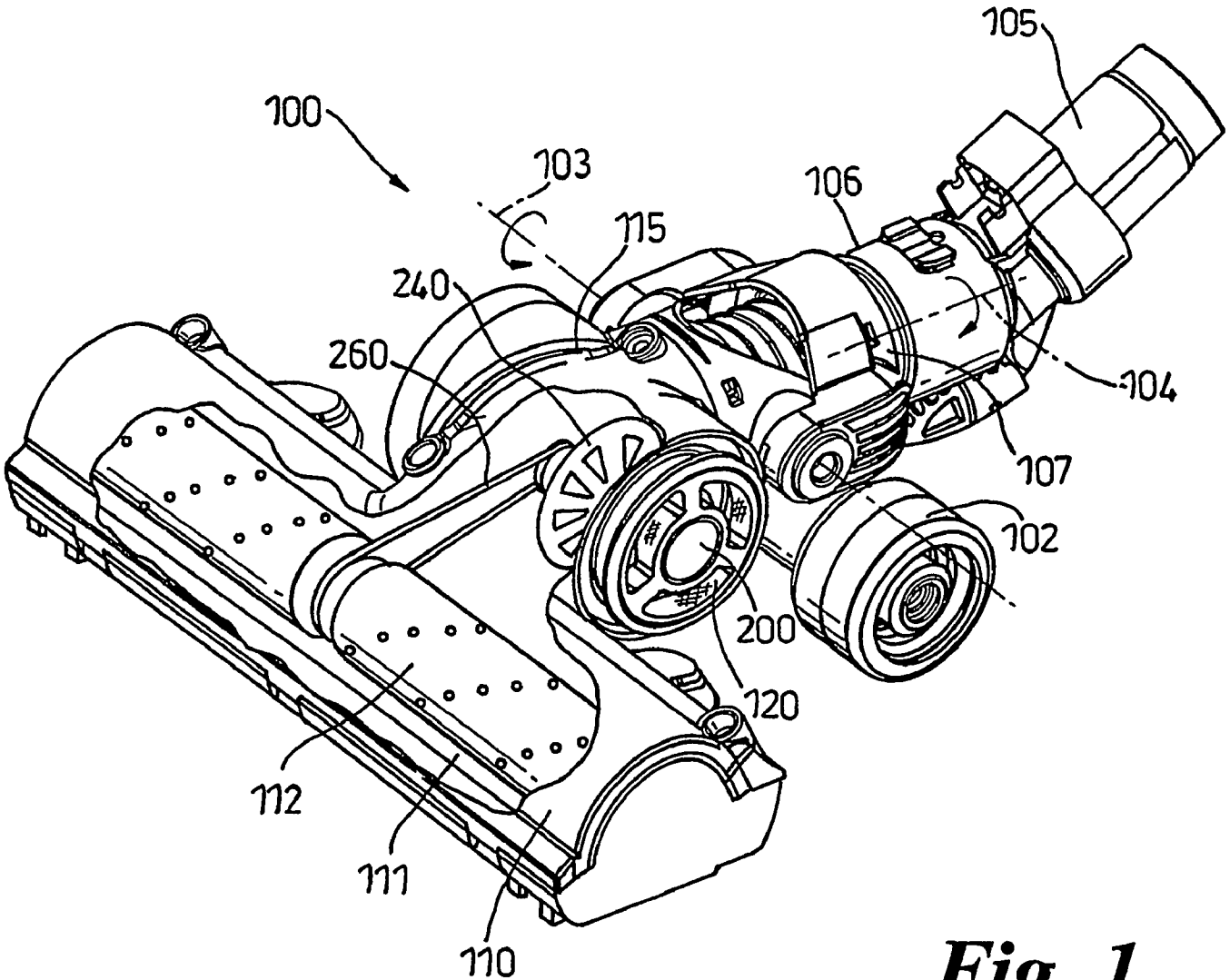
FIG. 1 shows a turbine-driven tool in accordance with the invention.

FIG. 1 shows an embodiment of the tool in the form of a tool 100 which can be fitted to the end of a wand or hose of a vacuum cleaner.

The main housing of the tool defines a chamber 110 for the brush bar 112, a chamber 115 for the turbine 240 and flow ducts between these parts. The forward, generally hood-shaped, part of the housing and a lower plate together define a chamber for housing the brush bar. The brush bar comprises two brush bars 112 of equal size which are supported, cantilever fashion, from a part of the driving mechanism positioned in the centre of the chamber 110. The lower plate has a large aperture 111 through which the bristles of the brush bars 112 can protrude to agitate the floor surface. The lower plate is fixed to the remainder of the housing by quick release (e.g. quarter turn) fasteners so that the plate can be removed to gain access to the brush bars 112.

Two wheels 102 are rotatably mounted to the rear part of the housing to allow the tool to be moved across a floor surface.

The air outlet of the tool comprises a first part 107 which is pivotally mounted about a horizontally aligned axis 103 on the main housing so as to permit pivotal movement in a vertical plane. A second part, in the form of an angled pipe portion 106, is rotatably connected, about an axis 104, to the end of part 107. Such an arrangement allows a good level of manoeuvrability of the floor tool 100 when in use and is commonly employed in known floor tools. Further description of the articulation of these components is unnecessary. The outlet 105 of the angled pipe portion 106 is shaped and dimensioned so as to be connectable to the wand of a domestic vacuum cleaner.

Figure 2:
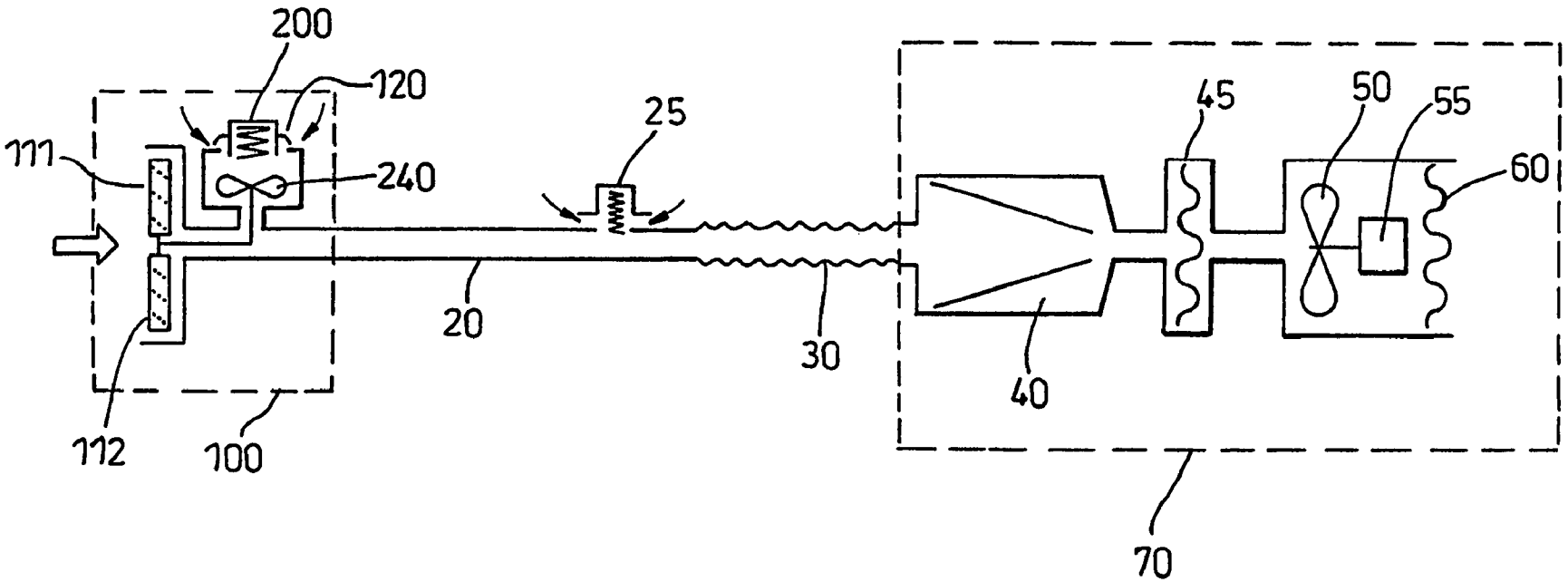
FIG. 2 schematically shows a vacuum cleaning system in which the tool can be used.

FIG. 2 schematically shows the overall vacuum cleaning system in which the tool can be used. The tool 100 is connected to the distal end of a rigid wand or pipe 20 which a user can manipulate to direct the tool 100 where it is needed. A flexible hose 30 connects the wand 20 to the main body 70 of the vacuum cleaner. The main body 70 of the vacuum cleaner comprises a suction fan 50 which is driven by a motor 55. The suction fan 50 serves to draw air into the main body 70 of the vacuum cleaner via the tool 100, wand 20 and hose 30. Filters 45 and 60 are positioned each side of the fan. Pre-motor filter 45 serves to prevent any fine dust from reaching the fan and post-motor filter 60 serves to prevent any fine dust or carbon emissions from the motor 55 from being expelled from the cleaner. A separator 40 such as a cyclonic separator or filter bag serves to separate and dirt, dust and debris from the dirty airflow which is drawn into the main body 70 by the suction fan 50. All separated matter is collected by the separator 40. In use, the suction force created by suction fan 50 draws air into the tool via the main suction inlet 111 on the underside of the tool and through the turbine air inlet 120. Air flowing through inlet 120 is used to drive the turbine before flowing along parts 107 and 106 towards the main body of the vacuum cleaner. Dirty air which is drawn through the main suction inlet flows along parts 107 and 106 and does not pass through the turbine at all. In this way, the turbine does not become fouled with dirt and debris from the dirty airflow.

Figure 3:
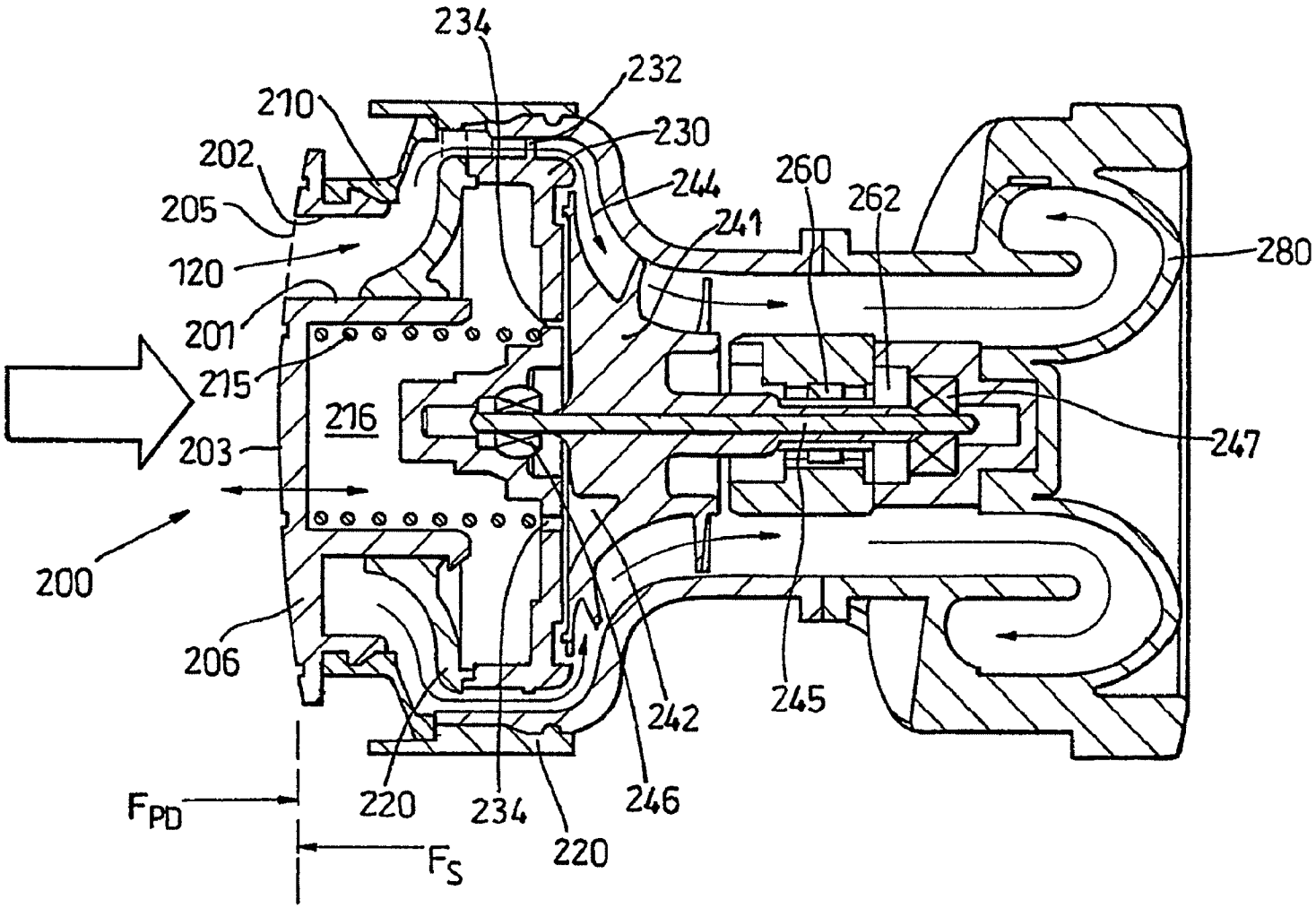
FIG. 3 shows a cross-section through the tool of FIG. 1 with the air inlet to the turbine open.

The turbine and the control mechanism for the turbine will now be described in detail with reference to FIG. 3. The impeller 241 of the turbine 240 is mounted about a drive shaft 245 within chamber 115. A set of bearings 246, 247 rotatably supports the drive shaft 245 at each of its ends. An air inlet 120 to the turbine is positioned at one end of the housing and an air outlet of the turbine is mounted at end 280. Airflow through the turbine is in a generally axial direction from left to right in FIG. 3.

A driving mechanism connects the turbine and the brush bars and serves to transmit torque from the turbine 240 to the brush bars 112. The driving mechanism comprises a first pulley 262, which is driven by the output shaft 245 of the turbine, a second, larger diameter, pulley at the brush bar, and a belt 260 which encircles the two pulleys. A casing 251, 252 surrounds the belt 260 to prevent the ingress of dust.

Figure 4:
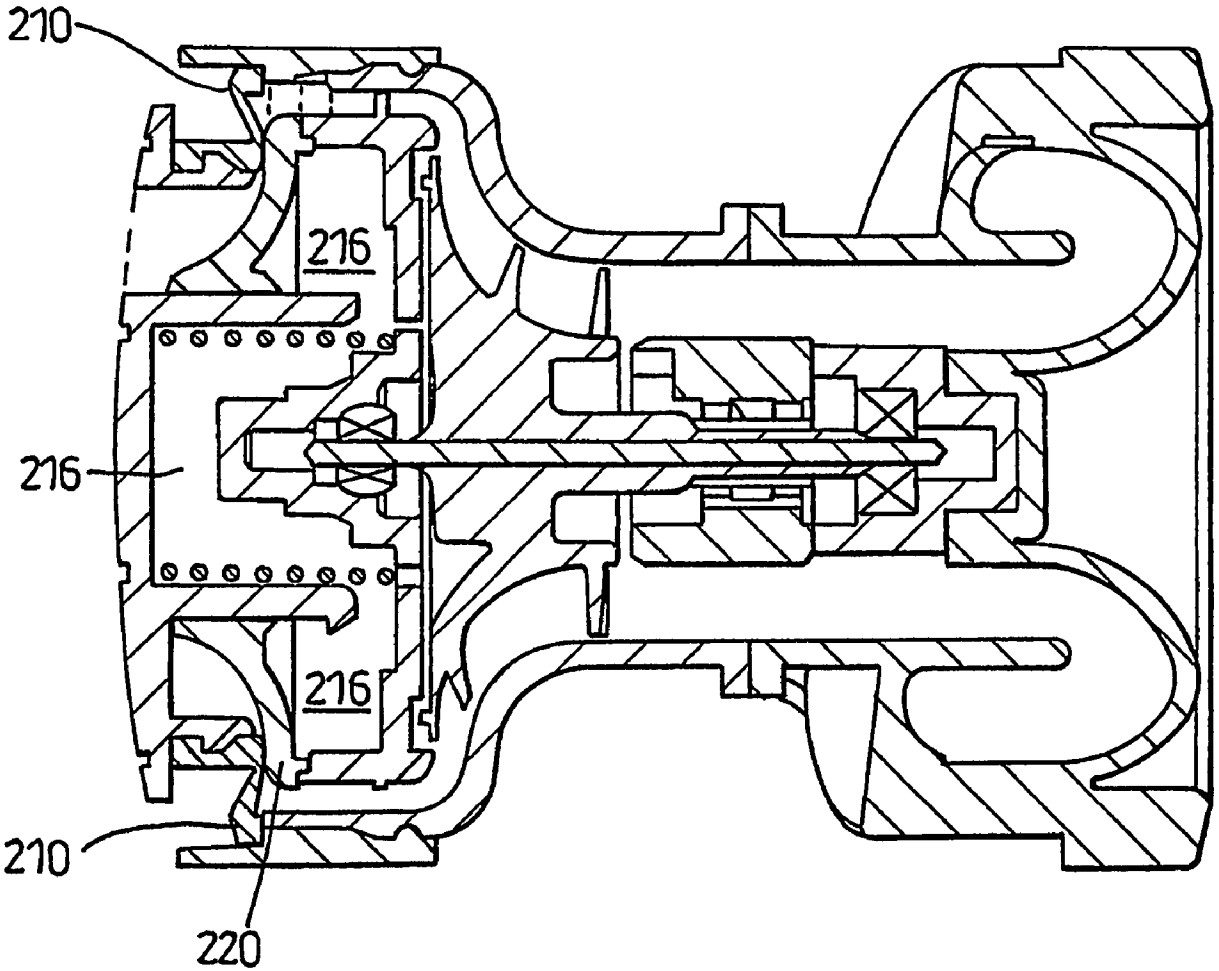
FIG. 4 shows a cross-section through the tool of FIG. 1 with the air inlet to the turbine closed.
Figure 5:
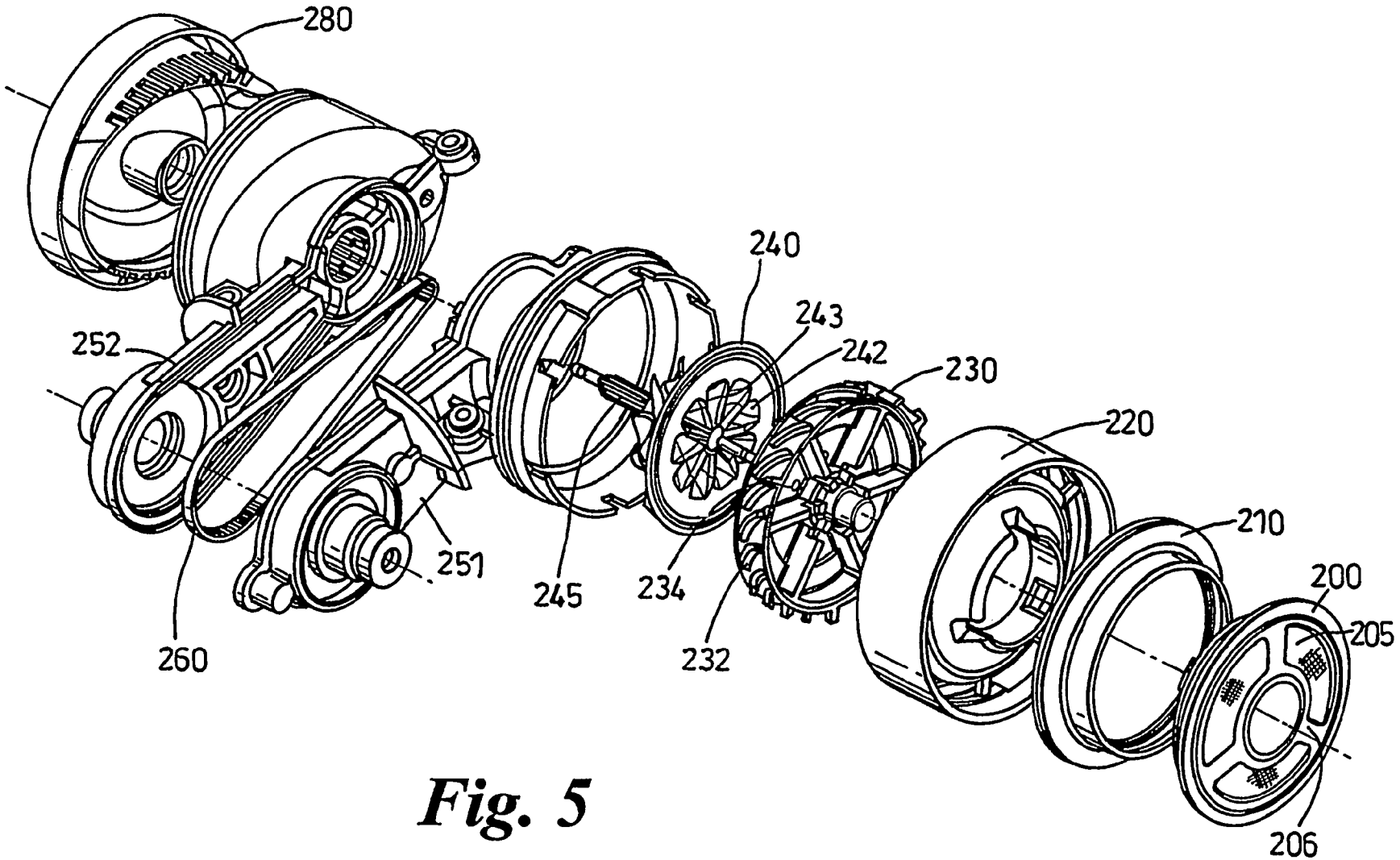
FIG. 5 shows an exploded view of the components of the tool shown in the previous Figures.

The inlet side of the turbine comprises a movable button 200 which is resiliently mounted about an inlet cap 220. The button 200 has an inner annular hub 201 and an outer annular hub 202. A spring 215 fits within the inner hub 201 and acts between the inside face of the central part 203 of the button 200 and a surface on the guide vane plate 230 and serves to urge the button 200 axially outwards. The outer annular hub 202 is joined to the housing by a flexible annular shaped diaphragm seal 210. As will be described in more detail below, the button 200 is axially movable from an 'open' position, as shown in FIG. 3, to a 'closed' position, as shown in FIG. 4. In the closed position the button 200 moves axially inward to a position where the diaphragm seal 210 presses against the outer surface of the inlet cap 220 so as to form an airtight seal at the inlet.

The outermost surface of the button 200, between the inner 201 and outer 202 annular hubs, comprises a plurality of radial ribs 206, with the spaces between adjacent ribs defining air inlet apertures 205. The inlet apertures 205 are shielded by a finely graded mesh which serves to prevent dust from being carried into the turbine and fouling the mechanism. The passage between the outer annular hub 202 and diaphragm seal 210, and the inner annular hub 201, defines an airway 120 for the incoming airflow which drives the turbine 240. The circumference of the guide vane plate 230 supports a set of angled vanes 232. The angle of the vanes 232 serves to initiate a swirling flow of air around the housing which is matched to the angle of the blades on the turbine 240. The main airflow path through the turbine is shown by the arrows 244. The turbine 240 shown here is an inward radial flow (IFR) turbine, which has been found to be well-suited to the pressure and flow rates in this application. However, it will be apparent that other types of turbine could be used, such as a Pelton Wheel.

There is also a secondary flow of air which plays an important part in operating the button 200 during an overspeed condition. The generally flat side of the turbine 240 (the left hand side of the impeller 241 in FIG. 3) has a plurality of depressions 242 defined in it, separated by ribs 243. In use, these depressions 242 and ribs 243 act as a miniature impeller, which will hereafter be called a secondary impeller. Obviously, since the secondary impeller is the rear face of the turbine 240, the two rotate at the same speed. The pumping effect of the secondary impeller is proportional to the rotational speed of the turbine 240. This causes a region of low pressure between the guide vane plate 230 and turbine 240. A plurality of axially directed apertures 234 in the supporting plate 230 join the region directly behind the turbine 240 with the region inside the button 200. The region inside the button is effectively a chamber which is separated from the main airflow path, except for the restricted path through the apertures 234. The only other flow into region 216 is a small, inevitable, leakage between the inner annular hub 201 of button 200 and the part of the inlet cap 220 against which the button 200 slides. The size of the apertures 234 is a trade off between being sufficiently large so as to effectively communicate the pressure behind the secondary impeller to the region 216 inside the button 200, and sufficiently small so that a large enough pressure difference is present in button 200 to enable a pumping effect to work. In use, the pumping action of the secondary impeller reduces the pressure in region 216. The forces at work are shown in FIG. 3. The spring 215 inside the button applies a force, labelled $F_S$, in an axially outward direction. There is also an axially directed force $F_{PD}$ on the button 200 which results from the pressure difference between ambient pressure on the outside of button 200 (shown as the large inwardly directed arrow) and the pressure in region 216 inside the button 216. When the vacuum cleaner is switched off, the air in region 216 is also at ambient pressure and thus the only net force acting on the button is that due to the spring 215. However, when the vacuum cleaner is operating, the pressure in region 216 is less than ambient due to the partial evacuation of air from region 216 by the secondary impeller. This pressure difference causes an axially inwardly directed force acting on the button. When the impeller is rotating at normal speeds, i.e. around 25-30 Krpm, the inwardly directed force $F_{PD}$, which is related to the pressure difference between ambient and the region inside the button 200, is insufficient to overcome the axially outwardly-directed biasing force of the spring $F_S$. Thus, the button 200 remains in the open position and air continues to flow to the turbine 240 to operate the brush bar.

When the airflow path through the main inlet becomes blocked in some way, such as by an object becoming trapped in the ducting or by the suction inlet becoming sealed against a surface, an increased amount of air will flow through the air inlet 120 to the turbine 240. This increase in airflow will increase the speed of rotation of the turbine 240 and secondary impeller. Other faults, such as a breakage of the drive belt 260, can also cause an increase in the rotational speed of the turbine 240. When the speed of rotation increases to a predetermined level, the pumping action of the secondary impeller causes a sufficient pressure difference between ambient and the region 216 inside the button 200, that the axially inwardly directed force on the button $F_{PD}$ can overcome the outwardly directed biasing force of the spring, $F_S$. Thus, the button 200 moves into the closed position, as shown in FIG. 4, and the diaphragm seal 210 presses against the inlet cap 220 to seal the inlet in an airtight manner. This prevents any air from reaching the turbine 240. As a result, the turbine 240 and the brush bar come to rest. Since the outlet side 280 of the turbine chamber continues to be in communication with the suction duct between the main suction inlet 111 on the tool and the main body 70 of the vacuum cleaner, which continues to be at low pressure, region 216 remains sufficiently evacuated to maintain the button 200 in the closed position. The speed of rotation which causes the button to move into the closed position is determined by factors which include the strength of the spring 215. We have found a maximum of speed of 45-50 Krpm is an ideal limit, but this can, of course, be varied.

There are several ways in which the button 200 can be restored to the open position. Firstly, the button 200 can be pulled, by a user, to the open position. Secondly, a valve can be provided to admit air into the airflow downstream of the turbine, or directly into the button 200 itself. This valve can be part of the tool or it can be a suction release trigger on the wand of the machine. Thirdly, turning off the machine has the same effect as operating the suction release trigger. Turning off the machine removes the source of suction on side 280 of the turbine, which raises the pressure in region 216 to ambient. With no pressure difference across the button 200 there is no inwardly directed force to oppose the spring 215, and thus the spring 215 can push the button 200 outward.

In order to better explain the use of a suction release trigger, we can refer again to FIG. 2. The suction release trigger 25 is a valve which is provided on most conventional machines. Often it is adjacent a handle of the wand. The suction release trigger 25 can be operated by a user to admit air into the wand and to reduce the level of suction at the tool 100. Normally, a user will operate this valve when something becomes stuck to the tool, such as a curtain. Air is admitted into the airflow path via the valve 25 and the object which has been 'stuck' to the tool is released. Operating the suction release trigger can also be used to restore the button 200 on the tool 100 to the open position and thus restart the turbine 240. The suction release valve 25 should admit a sufficient amount of air into the main flow path, lowering the pressure difference across the button 200 sufficiently that the spring 215 can push the button 200 into the open position.

Figure 6:
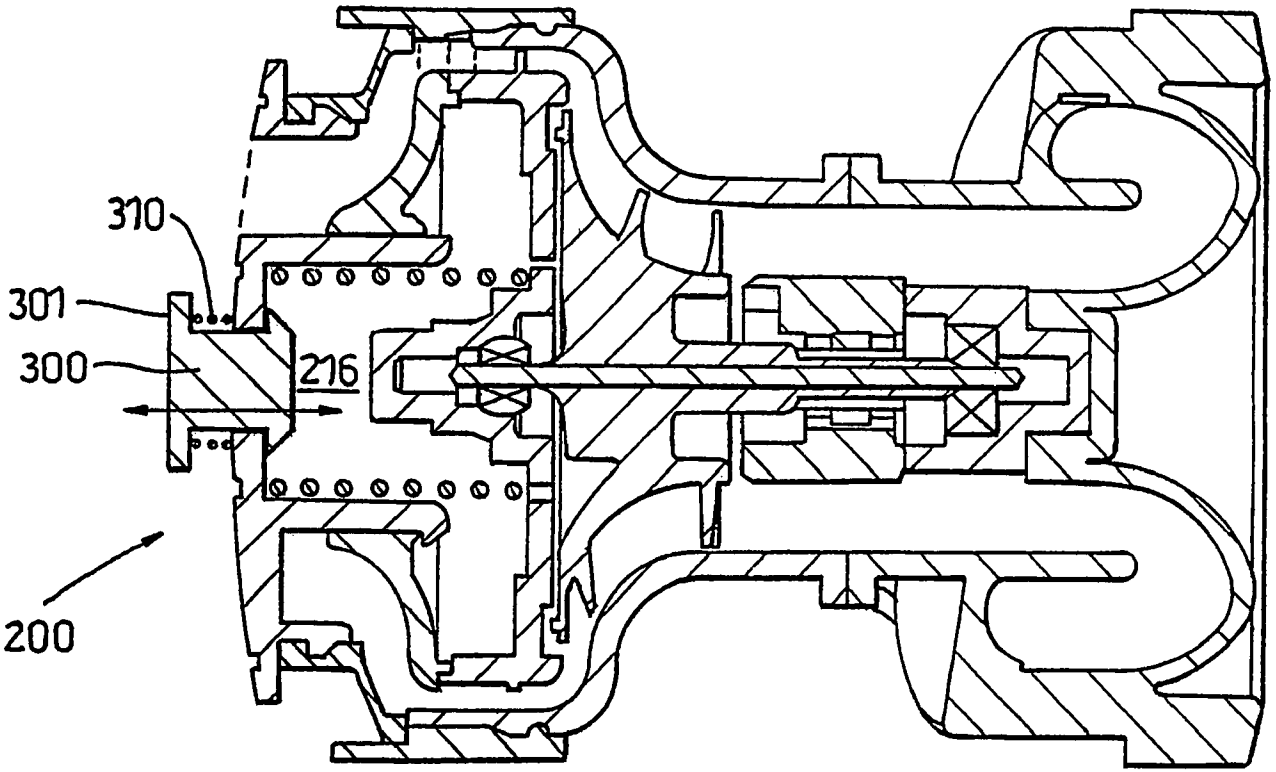
FIG. 6 shows a modification to the tool to allow the air inlet to be reopened.
Figure 7:
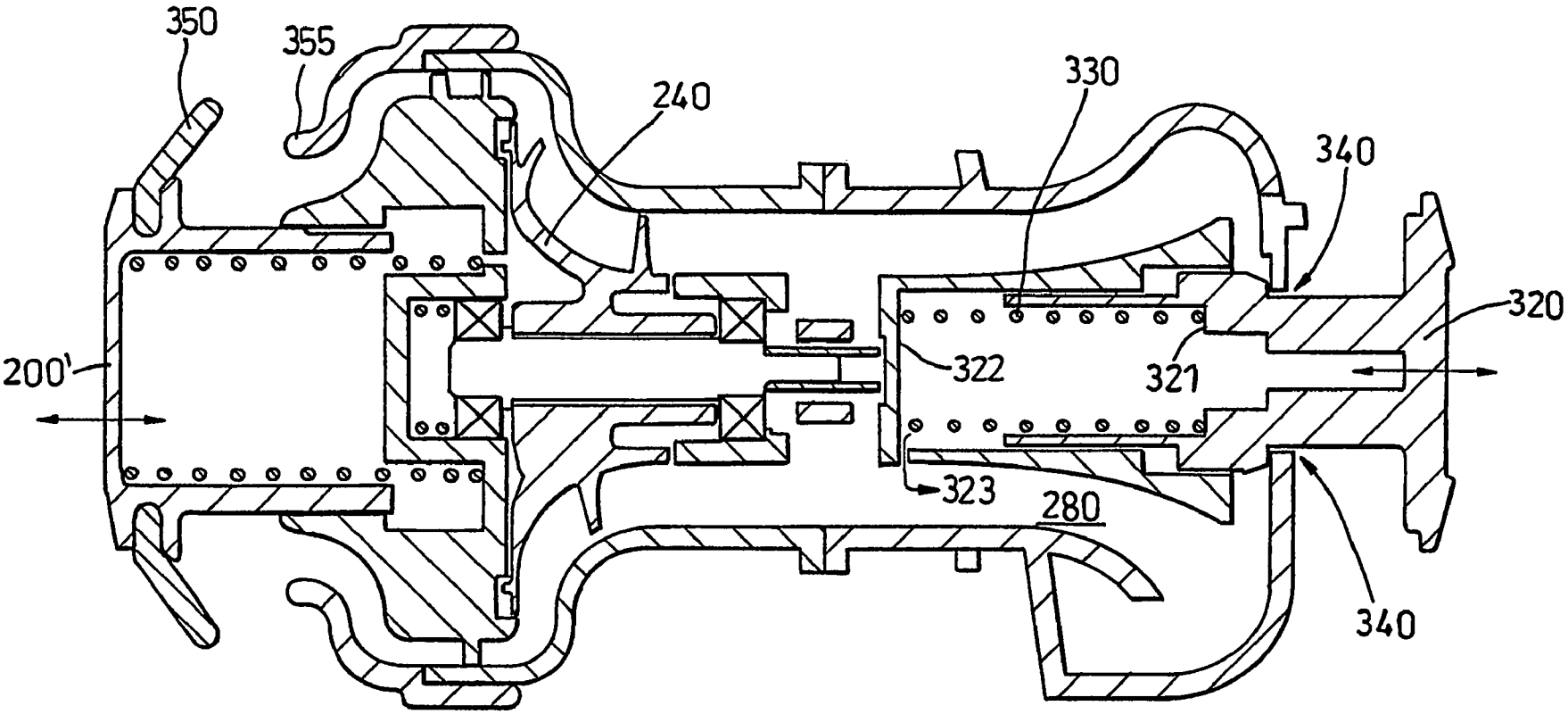
FIG. 7 shows an alternative way in which the tool can be modified to allow the air inlet to be reopened.

FIGS. 6 and 7 show some further embodiments of the tool in which valves are provided. In FIG. 6 a valve is mounted in button 200 itself. The valve comprises a further button 300 which is ordinarily biased into a closed position by spring 310. The spring 310 acts between flange 301 and the outer surface of button 200. In use, a user can displace the button 300, in the direction shown by the double-headed arrow, to admit air into the region 216 inside the button 200. This will raise the pressure in region 216 towards ambient, thus reducing the pressure difference force $F_{PD}$. When the value of $F_{PD}$ is reduced sufficiently, the spring force $F_S$ will overcome the inwardly directed force $F_{PD}$ and the button 200 will move to its open position, as shown in FIG. 3.

FIG. 7 shows a scheme where a manually operable valve is mounted downstream of the turbine 240, as part of the tool 100. A button 320 is ordinarily biased into a closed position, as shown, by spring 330. The spring 330 acts between a step on the axially innermost end 321 of button 320 and surface 322 of the chamber in which the button lies. In use, a user can displace the button 320 to admit air through inlet 340 into the region 280 downstream of the turbine. The region inside button 200' is in communication through opening 323 with the region 280 into which the air is bled by button 320. Thus, the force $F_{PD}$ due to evacuation of the button 200' will be reduced. When the value of $F_{PD}$ is reduced sufficiently, the spring force $F_S$ will overcome the inwardly directed force $F_{PD}$ and the button 200' will move to its open position, as shown in FIG. 3.

Button 320 can also act as an automatic bleed valve, i.e. the button 320 automatically moves into the open position in response to the flow of air along the passage 280. In a similar way to how the region inside button 200 (200') can be partially evacuated by the pumping effect of the secondary impeller, the region inside button 320 is evacuated by the flow of air along passage 280. When button 320 is evacuated sufficiently, it moves into the open position and admits air into the region 280 downstream of the turbine. This has the effect of slowing down the turbine 240. Of course, if the amount of air which is bled into the region 280 by button 320 is insufficient to prevent the turbine 240 from overspeeding, the button 200' will close to seal off the air inlet to the turbine.

The arrangement shown on the right hand side of FIG. 7 (i.e. button 320, spring 330, inlet 340) can be used on its own, without the button 200' on the inlet to the turbine 240. This would provide a speed limiting function for the turbine 240, without the ability to turn the turbine off.

FIG. 7 shows another modification to the tool. The inlet seal is an annular cap 350 which can seal the inlet by pressing against region 355 of the turbine housing. This alternative is less appealing than the one shown in FIGS. 3 and 4 since the surfaces which seal against one another, i.e. the inside face of seal 350 and surface 355, are exposed to dirt-laden air, compared to FIG. 3, where the sealing surfaces are only exposed to air which has passed through a mesh screen.

From the above, it will be clear that button 200 can automatically move into a closed position and seal the air inlet to the turbine when the turbine rotates too quickly. Another useful feature of this arrangement is that a user can manually press the button 200 into the closed position should they wish to turn off the brush bar, e.g. when cleaning hard floors or delicate surfaces. To manually turn off the brush bar, a user simply pushes button 200, against the bias of spring 215, and momentarily holds the button 200 in the closed position. Pushing the button 200 evacuates region 216 inside the button 200 in the same manner achieved by the secondary impeller during an overspeed condition. The brush bar can be turned on again in the same manner as previously described.

One of the problems with a turbine-driven tool which has a dedicated inlet for air to drive the turbine is that too great a proportion of the incoming air can flow into the tool via the main inlet rather than through the turbine. When viewed in terms of the amount of resistance experienced by the airflow, the path through the main inlet offers a lower resistance than the path through the turbine inlet.

Figure 8:
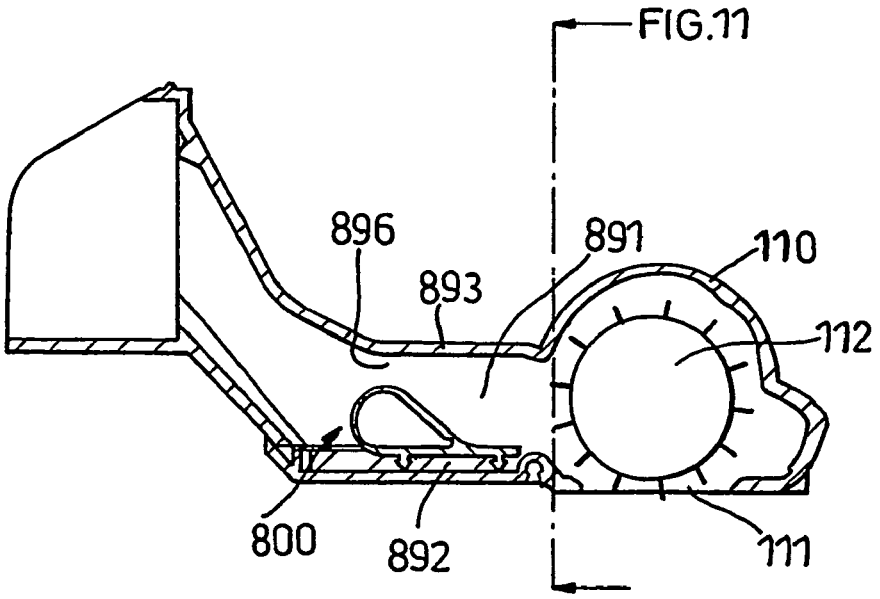
FIG. 8 shows a cross-section through a turbine driven tool which incorporates a device for restricting the cross-section of the outlet path from the brush bar housing.
Figure 9:
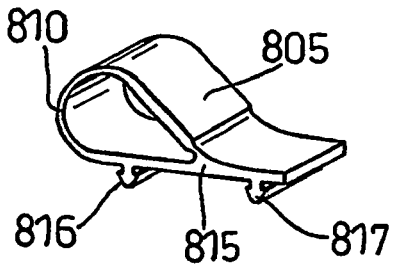
FIGS. 9 and 10 show the restricting device itself.
Figure 10:
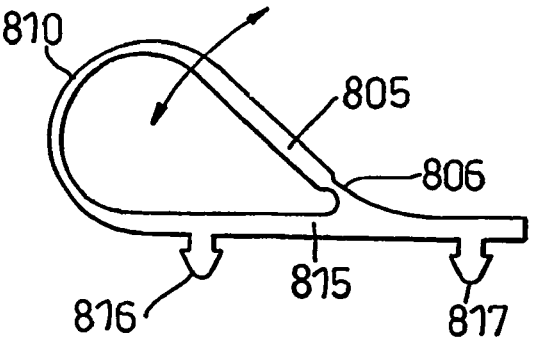
Figure 11:
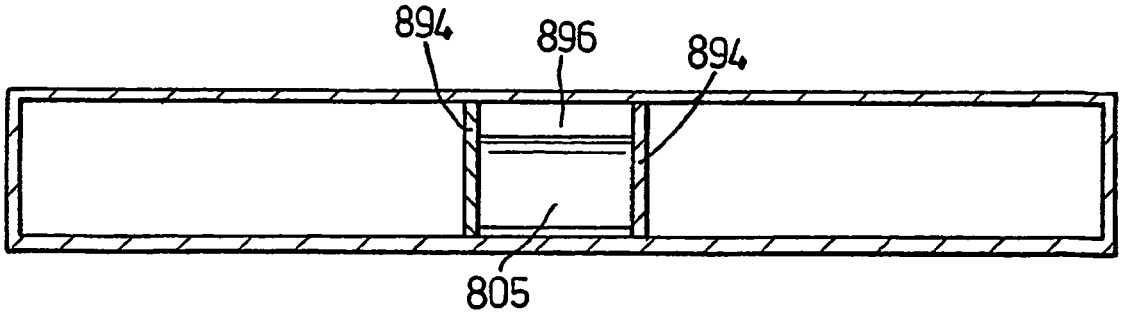
FIG. 11 shows a cross-sectional view through the tool of FIG. 8.

In the embodiment shown in FIGS. 8-11 the restricting device 800 has a base 815 with fixings 816, 817 which push fit into the wall 892 of the discharge outlet 891 so as to secure the restricting device 800 in place. A loop 805, 810 of material is secured to the base 815. The loop has a first part 805, which will be called a guide vane, which is inclined with respect to the base 815. A generally semi-circularly shaped element 810 joins the guide vane 805 with the base 815. The guide vane 805 and semi-circular element 810 can be molded integrally with one another, and with the base 815, from a material which is resiliently flexible. A rubber compound such as EPDM is suitable. In use, the guide vane 805 remains in an inclined position to the base 815, and hence the walls 892, 893 of the discharge outlet 891, and serves to restrict the cross-section of the outlet, as can be seen in FIG. 11. Reference numeral 896 represents the part of the outlet aperture through which air can flow. The angle of inclination of guide vane 805, in use, will usually be less than what is shown in FIG. 8 due to the force caused by the flow of air through the outlet, but it will still be inclined. In the event that a large piece of debris flows along the outlet duct, the guide vane 805 rotates towards wall 892, adopting a position which is more parallel with the base member 815. Narrowed portion 806 between guide vane 805 and base 815 acts as a hinge to permit guide vane 805 to rotate. Once the debris has passed, the guide vane 805 returns to its original position, due to the resilience of element 810. Vertical walls 894 of the discharge outlet 891 lie alongside each side of the device 800 and thus the area inside the loop is not exposed to dirt-laden airflow.

Figure 12:
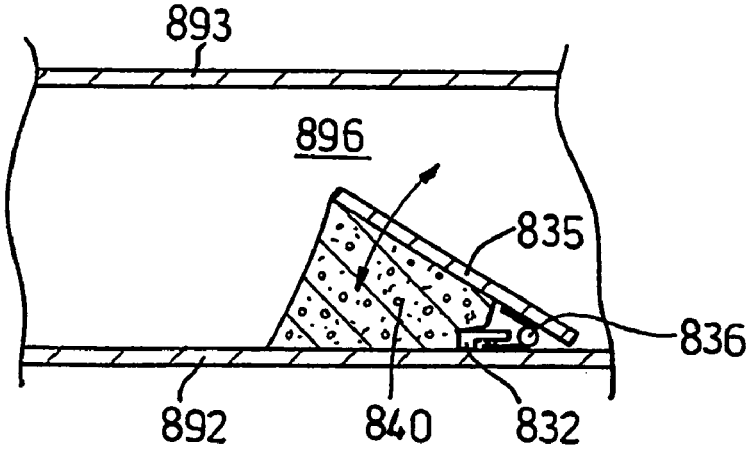
FIGS. 12 to 14 show alternative forms of the restricting device.
Figure 13:
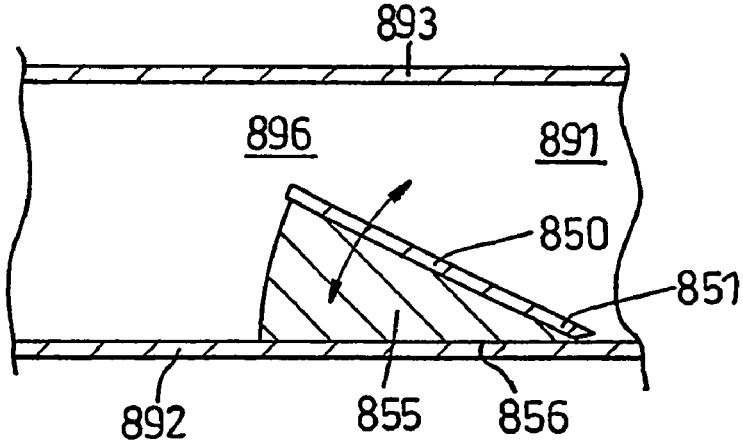

The restricting device can be implemented in other ways. FIGS. 12 and 13 show two alternative embodiments. In FIG. 12, the guide vane 835 is a planar element which is mounted to wall 892 of the discharge outlet by a torsion spring 836. The spring is received in a pocket 832 in the wall of the discharge outlet. The spring 836 serves to maintain the vane 835 in an inclined position with respect to the wall. The space beneath the guide vane 835 is filled by a generally wedge-shaped piece of foam material 840 which can readily compress when the guide vane 835 pivots towards the wall. The foam material 840 prevents any debris from accumulating beneath the guide vane 835, which would prevent the guide vane 835 from operating.

In the embodiment shown in FIG. 13 the guide vane is again a planar element 850. However, there is no spring. Instead, the resilience is supplied by a generally wedge-shaped piece of material 855 which serves the dual purpose of maintaining element 850 in an inclined position and preventing the ingress of any dirt beneath the element. The lower surface 856 of material 855 can be secured to the wall 892 of the discharge outlet by bonding or other suitable means. Element 850 can be secured to the upper surface of material 855 by similar means. The wedge shape of the material 855 ensures that the element 850 will pivot about end 851 when any debris strikes the element 850. In a further, alternative, element 850 is not provided as a separate element, but is simply the upper, exposed surface of the material 855. In this case, the material 855, or at least the exposed surface, should be suitably resistant to the passage of debris over the surface.

Figure 14:
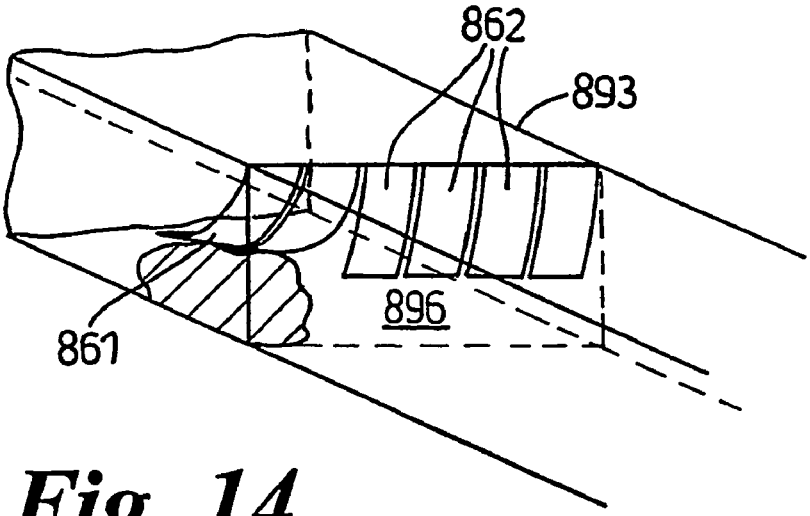

In the further alternative embodiment shown in FIG. 14 the restriction in the outlet duct 893 is achieved by a plurality of flexible flaps 861, 862 which hang from the upper wall of the duct 893. The length of the flaps 861, 862, the rigidity of the material from which the flaps are made and the flexibility of the connection between the flaps 861, 862 and the wall of the duct 893 determine the extent to which the cross-section of the outlet duct will be restricted. FIG. 14 shows two of the flaps 861 being displaced by a large item of debris. It will be noted that not all of the flaps need move to allow the debris to pass along the duct. This has a benefit in maintaining the distribution of airflow between the main inlet and turbine inlet. Of course, in a simpler form of this arrangement, there need only be a single such flap 861 which extends fully, or only part-way, across the duct 893. The arrangements shown in FIGS. 8-13 can also be implemented in a way in which a plurality of similar (or dissimilar) parts are positioned across the duct 893, each part occupying only a portion of the total width of the duct 893 and being independently movable.

Various alternatives are possible to what has been described here. While the two replaceable brushes are preferable, in a simpler form of the tool there could only be a single brush bar which is directly driven by a belt passing around the outer surface of the brush bar. The brush bar can be driven at a position which is offset from the centre.

The preferred way of operating the button 200 is to provide a secondary impeller 244 on the rear face of the turbine 240. Depressions 242 and ribs 243 form this secondary impeller. However, the following alternative schemes are also possible, and are intended to be included in the scope of the invention. Instead of using the rear face of the turbine 240, a second, dedicated, impeller could be mounted on the drive shaft 245 at a position which is axially offset from the main impeller 241 of turbine 240. Obviously, this would increase the cost and size of the tool. As a further alternative, the rear face of the turbine 240 could be flat, rather than having depressions 242 and ribs 243. As a still further alternative, the means for evacuating the region 216 inside the button can be a venturi in the main airflow path to or from the turbine.

The embodiments show a horizontally mounted turbine assembly with the button 200 on one side of the tool. It is possible to mount the turbine vertically within the housing of the tool so that the button 200 is positioned on the upper face of the tool. This arrangement allows the button 200 to be equally accessible to left and right handed users.

The invention claimed is:

1. A vacuum cleaning head, comprising:

a housing having a suction inlet, an agitator for agitating a floor surface which is rotatably mounted in the housing, a first air turbine driving the agitator, a turbine air inlet, separate from the suction inlet, admitting air separately from air admitted by the suction inlet to the first turbine, and a control moveable to control the amount of air admitted by the turbine air inlet to the first turbine so as to prevent rotation or reduce the speed of rotation of the agitator, the control moving in response to the speed of rotation of the first turbine or to a flow of air to or through the first turbine, the control comprising a moveable part having a recess, the recess forming an interior volume which communicates with a main airflow path to the first turbine, the moveable part moving in response to a force generated by a pressure difference between the interior volume and ambient air.

2. A vacuum cleaning head according to claim 1, wherein the control is movable between an open position, in which it admits air to the turbine, and a closed position in which it prevents air from reaching the turbine.

3. A vacuum cleaning head according to claim 2, wherein the control is biased into the open position.

4. A vacuum cleaning head according to claim 2 or 3, wherein the control is also movable into the inoperable position by a user.

5. A vacuum cleaning head according to claim 1, wherein the interior volume of the movable part communicates with the main airflow path to the turbine via a restricted airflow path.

6. A vacuum cleaning head according to claim 5, wherein the restricted airflow path comprises an apertured plate.

7. A vacuum cleaning head according to claim 1, further comprising a device drawing air from the interior volume of the movable part.

8. A vacuum cleaning head according to claim 7, wherein the drawing device comprises a second turbine.

9. A vacuum cleaning head according to claim 8, wherein the second turbine forms part of the rear face of the first turbine.

10. A vacuum cleaning head according to claim 9, wherein the second turbine comprises depressions and ribs on the rear face of the first turbine.

11. A vacuum cleaning head according to claim 7, wherein the drawing device comprises a venturi in the airflow path upstream or downstream of the first turbine, the interior volume of the movable part communicating with the venturi.

12. A vacuum cleaning head according to claim 1, further comprising a valve for admitting air into the interior of the movable part so as to reopen the turbine air inlet.

13. A vacuum cleaning head according to any one of claims 1 to 3, further comprising a seal sealing the turbine air inlet in the closed position.

14. A vacuum cleaning head according to any one of claims 1 to 3, further comprising a valve admitting air to the cleaning head to reopen the turbine air inlet.

15. A vacuum cleaning head according to claim 14, wherein the valve is configured to admit air to a region downstream of the first turbine.

16. A vacuum cleaning head according to claim 15, wherein the valve is positioned on the opposite side of the housing to the control.

17. A vacuum cleaning head according to any one of claims 1 to 3, further comprising a plurality of restricting devices arranged across a discharge outlet.

18. A vacuum cleaning head, comprising:

a housing having a suction inlet, an agitator for agitating a floor surface which is rotatably mounted in the housing, an air turbine driving the agitator, a turbine air inlet, separate from the suction inlet, admitting air separately from air admitted by the suction inlet to first turbine, and a control comprising a button and a flexible diaphragm, the button being moveable by a user between an open position in which air is admitted by the turbine air inlet to the turbine, and a closed position in which the diaphragm seals the turbine air inlet to prevent air reaching the turbine and thus prevent rotation of the agitator.

19. A vacuum cleaner head as claimed in claim 18, wherein the button comprises an inner hub, an outer hub, and a plurality of ribs extending between the inner hub and the outer hub, and the spaces between adjacent ribs define air inlet apertures.

20. A vacuum cleaner head as claimed in claim 19, wherein the button comprises a mesh that shields the air inlet apertures.

21. A vacuum cleaner head as claimed in claim 18, wherein the button is joined to the housing by the diaphragm.

22. A vacuum cleaner head as claimed in claim 18, wherein the button is resiliently mounted about an inlet cap, and the diaphragm presses against an outer surface of the inlet cap to seal the turbine air inlet when the button is in the closed position.

23. A vacuum cleaner head as claimed in claim 18, wherein the turbine has an axis of rotation, and the button moves between the open position and the closed position along the axis of rotation.

24. A vacuum cleaner head as claimed in claim 18, wherein the cleaner head comprises a guide vane plate that supports a set of angled vanes around a circumference, and the angled vanes initiate swirling of air admitted to the turbine.

25. A vacuum cleaner head as claimed in claim 24, wherein the cleaner head comprises a spring that acts between the button and the guide vane plate to urge the button into the open position.

26. A vacuum cleaner head as claimed in claim 18, wherein the turbine is a radial flow turbine.

* * * * *